US005882406A

United States Patent [19]

Becker et al.

[11] Patent Number: 5,882,406

[45] Date of Patent: Mar. 16, 1999

[54] FILM APPLICATOR WITH ADJUSTABLE DYNAMIC EXTRACTION FLOW REGULATOR

[75] Inventors: Rex A. Becker, Janesville, Wis.; Alfred C. Li, Naperville, Ill.

[73] Assignee: Beloit Technologies, Inc., Wilmington, Del.

[21] Appl. No.: 893,595

[22] Filed: Jul. 14, 1997

Related U.S. Application Data

[63] Continuation-in-part of Ser. No. 518,093, Aug. 22, 1995.

[51] Int. Cl.[6] ..... B05C 3/02

[52] U.S. Cl. ..... 118/410; 118/419

[58] Field of Search ..... 251/205, 333; 118/410, 414, 413, 411, 419

[56] References Cited

U.S. PATENT DOCUMENTS

| | | | |
|---|---|---|---|
| 3,666,235 | 5/1972 | Scott | 251/205 |
| 4,369,731 | 1/1983 | Damrau | 118/410 |
| 4,780,336 | 10/1988 | Damrau | 427/356 |
| 4,842,245 | 6/1989 | Kelsey | 251/205 |
| 4,892,057 | 1/1990 | Zimmer | 118/248 |
| 4,945,855 | 8/1990 | Eklend et al. | 118/410 |
| 5,104,697 | 4/1992 | Heikkinen et al. | 427/356 |
| 5,433,781 | 7/1995 | Bernert | 118/118 |

OTHER PUBLICATIONS

"Optiblade™–a new method for high–speed LWC coating," article by Jukka Linnonmaa and Martti Tyrväinen, 3 pages, *Paper News*, published by Valmet Corporation, Helsinki, Finland.

*Primary Examiner*—Brenda A. Lamb
*Attorney, Agent, or Firm*—Lathrop & Clark LLP

[57] ABSTRACT

A short dwell coater and film applicator coating has an application chamber between an inlet overflow baffle plate and a final metering element. An adjustable wedge is spaced in the machine direction from a fixed wedge to define a gap which serves as a coating extraction port. A cylindrical rod is positioned in the extraction port which is about ⅜th to about two inches in diameter and is driven to rotate at a rate of between one and one-hundred rpm. The rod serves to extract air and coating from the application chamber. Alternatively, an adjustable plate may be positioned to obstruct an opening leading to the extraction port.

24 Claims, 5 Drawing Sheets

FILM APPLICATOR WITH ADJUSTABLE DYNAMIC EXTRACTION FLOW REGULATOR

RELATED APPLICATION

This application is a continuation-in-part of application Ser. No. 08/518,093, filed Aug. 22, 1995.

FIELD OF THE INVENTION

The present invention relates to apparatus for applying coatings to moving substrates such as paper and applicator rolls.

BACKGROUND OF THE INVENTION

Paper of improved surface characteristics may be created by applying a thin layer of coating material to one or both sides of the paper. The coating is typically a mixture of a fine plate-like mineral, typically clay or particulate calcium carbonate; coloring agents, typically titanium dioxide for a white sheet; and a binder which may be of the organic type or of a synthetic composition. In addition, rosin, gelatins, glues, starches or waxes may be applied to paper for sizing.

Coated paper is typically used in magazines, commercial catalogs and advertising inserts in newspapers and in other applications requiring good quality color photo printing.

Coated ground-wood papers include the popular designation "lightweight coated" (LWC) paper. Ground-wood pulp contains lignin, which is a brown colored organic substance that acts as a binder in raw wood. The lignin reduces the cost of paper by increasing the yield of paper obtained from raw wood. At the same time it produces a paper with a surface that is less suitable for printing color photos and glossy images. Coating the ground-wood paper improves the printing quality while retaining the low cost advantage. For lightweight coated paper, coating weight is approximately thirty percent of total sheet weight. These grades of paper are popular with magazine publishers, direct marketers, and commercial printers as the lighter weight paper saves money on postage and other weight-related costs. With the increasing demand for lighter weight, lower cost coated papers, there is an increasing need for more efficiency in the production of these paper grades.

Paper is typically more productively produced by increasing the speed of formation of the paper, and coating costs are kept down by coating the paper while still on the papermaking machine. Because the paper is made at higher and higher speeds and because of the advantages of on-machine coating, the coaters in turn must run at higher speeds. The need in producing lightweight coatings to hold down the weight of the paper and the costs of the coating material encourages the use of short dwell coaters for their superior runnability at high machine speeds. Thus, high speed coating machines are key to producing lightweight coated papers cost-effectively.

Currently, coating applicators apply coating to the web in two separate manners. One is a direct application of a thin film by the coating applicator onto the moving web. The other is by application onto a transfer medium, i.e., an applicator roll, which then applies the thin film of fluid onto the web. Devices using either application approach may be classified as film applicators.

A typical film applicator has a coating application chamber that serves as an application region. One boundary wall of the application region is provided by the moving substrate, i.e. a paper web or blanket supported by a backing roll, an applicator roll, etc. Coating within the application chamber is effectively transferred onto the substrate. The substrate enters the application chamber through an overflow region where it meets the coating fluid at the dynamic contact line. The boundary layer adjacent to the moving substrate enters the application chamber containing air, and as it moves through the application chamber the air is replaced with coating. The substrate exits the application chamber at a metering element that controls the thickness of the applied coating. The application chamber provides the means for accelerating the coating fluid up to the speed of the moving substrate by allowing internal flow recirculation. The application chamber attenuates the cross-machine direction flow variations by permitting overflow through the baffle. In general, the residence time is short for the substrate, but can be relatively long for the coating fluid.

The major problem associated with this type of film applicator is the appearance of uncontrollable, nonuniform cross-machine direction and machine direction coat weight distributions on the substrate as the machine speed exceeds some critical speed limit. This speed limit depends upon the flow geometry in the application region and the rheological properties of the coating fluid. These non-uniformities exhibit a characteristic cross-machine length scale that appears to be proportional to the dimension characteristic of the active region where flow instabilities and disturbances take place.

Experimental data with a film applicator has revealed that the hydrodynamic instabilities induced by the presence of three-dimensional vortexes in the application chamber as well as flow disturbances created by the entrainment of air at the dynamic contact line and from the coating feed supply are important phenomena contributing to a nonuniform coat weight distribution. However, the relationship between these two phenomena is still unknown.

When a fluid is driven away from its stable equilibrium mode due to a change in operating conditions, it will often undergo a sequence of instabilities, each of which leads to a change in the spatial or temporal structure in the flow. In the present case, hydrodynamic instabilities develop as a result of the coating fluid undergoing transitions in different dynamic regimes, such as the shift from stable flow to an unstable flow as the Reynolds number (or machine speed) increases. The Reynolds number (Re) may be defined as:

$$Re = \frac{\rho L u}{\mu}$$

Where $\rho$ is the density of the coating fluid, u is the characteristic velocity (substrate speed), L is the characteristic dimension of the active region where the state of flow undergoes different dynamic changes, and $\mu$ is the apparent viscosity of the coating fluid. The stability of flow in the active region can influence the uniformity of velocity and pressure profiles that, in turn, affect the coat weight distribution on the substrate.

Although air entrainment has been the subject of research in a number of areas related to a moving substrate entering into or contacting with an unpressurized liquid system, it is apparent that even at a low machine speed, there is still a lack of fundamental understanding of how air is entrained at the dynamic contact line, how much air volume enters with the moving substrate, and where the entrained air goes. Overall, any phenomenon observed at a low machine speeds tends to be magnified and become even worse as the machine speed increases.

For the case of flow in a pressurized film applicator, the amount of air being entrained increases as the machine speed increases. At the same time, this same speed increase and the increased volume of air create flow disturbances in the coating application chamber, disrupting the uniformity of the velocity and pressure profiles as well as the desired boundary layer adjacent to the moving substrate. At lower machine speeds, most of the air is successfully displaced or removed via the overflow region. At faster machine speeds, however, an increasingly larger volume of air is forced out through the overflow or possibly underneath the metering blade. This combined action of flow instability and uncontrolled air removal results in the emergence of the coat weight variations on the substrate.

What is needed is a film applicator that provides greater control over the conditions in the coating application chamber so that coating conditions can be adjusted as machine speed increases to overcome flow instability in the coating application chamber.

SUMMARY OF THE INVENTION

The short dwell coater and film applicator of this invention employs a coating head having an inlet overflow baffle plate and a final metering element. An application chamber is created upstream of the baffle plate. Two wedges are mounted to the applicator housing beneath the backing roll. Each wedge has a surface which faces the backing roll and defines a region which converges as the wedges extend downstream. The wedges are spaced from each other in the machine direction to define a gap which opens toward the backing roll. A cylindrical rod extends in the cross machine direction within the gap. The rod is about ⅜th to about two inches in diameter and is driven to rotate at a rate of between one and one-hundred rotations per minute (rpm). The rod serves to extract air and coating from an application chamber formed between the wages, the backing roll, and the overflow baffle plate. The rod provides an additional independently controllable element in the coater that allows better control and tuning of the application chamber to eliminate streaking due to application chamber instability that occurs with higher machine speeds.

An alternative embodiment coater uses an adjustable plate positioned to obstruct the opened or gap formed between the pair of wedges positioned opposite the backing roll. The adjustable plate controls pressure and extraction rate by allowing more or less coating to be drawn through the gap between the wedges.

It is a feature of the present invention to provide a coater that can be adjusted rapidly when machine speed or other conditions are varied.

It is another feature of the present invention to provide a coater that can provide controlled extraction rates of coating from a coating application chamber.

It is a further feature of the present invention to provide a coater that provides high speed on-machine coating.

It is a yet further feature of the present invention to provide a coater that operates at higher machine speeds.

Further objects, features and advantages of the invention will be apparent from the following detailed description when taken in conjunction with the accompanying drawings.

DESCRIPTION OF THE PREFERRED EMBODIMENT

Figure 1:
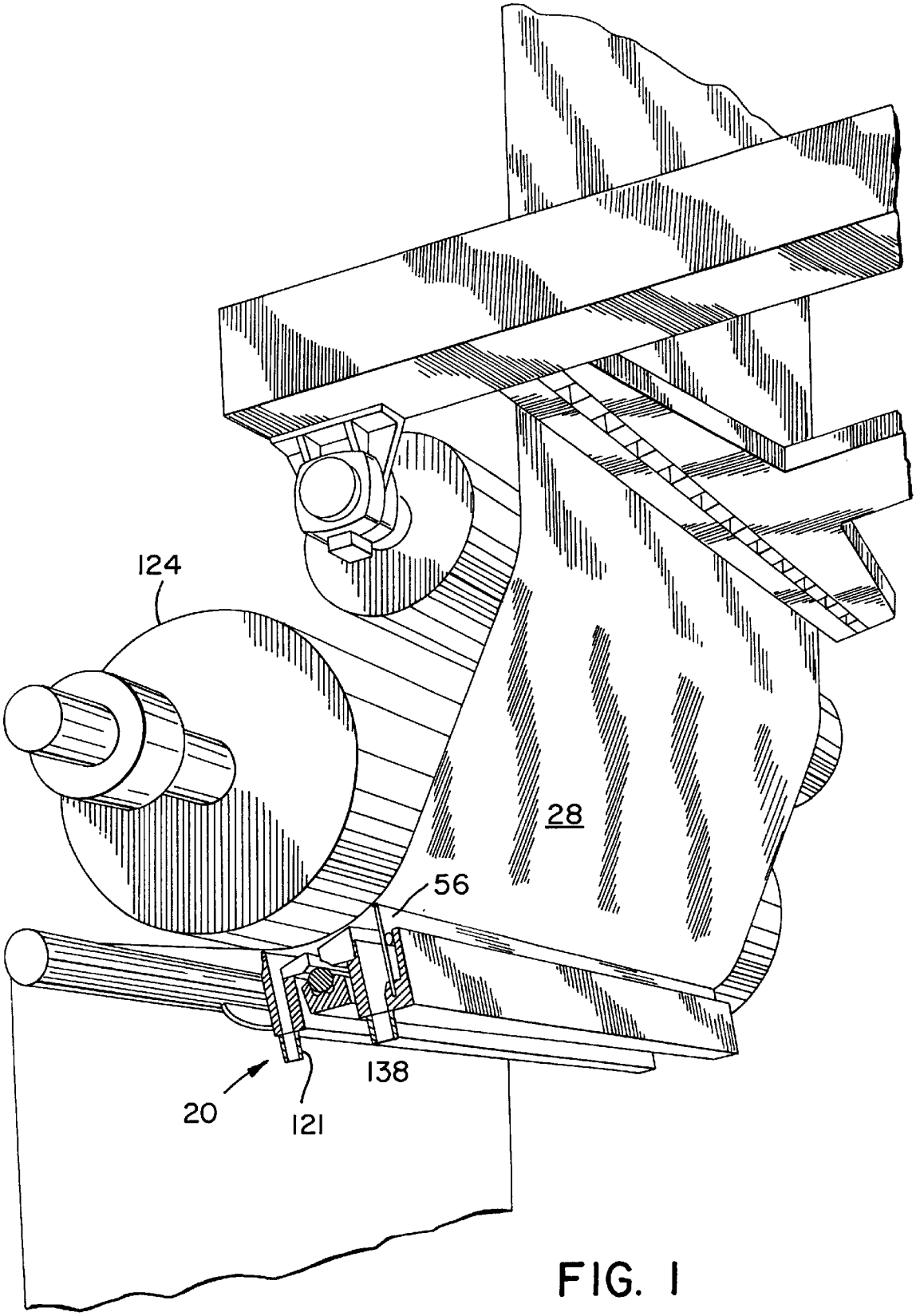
FIG. 1 is a schematic perspective view of a coater of this invention.
Figure 2:
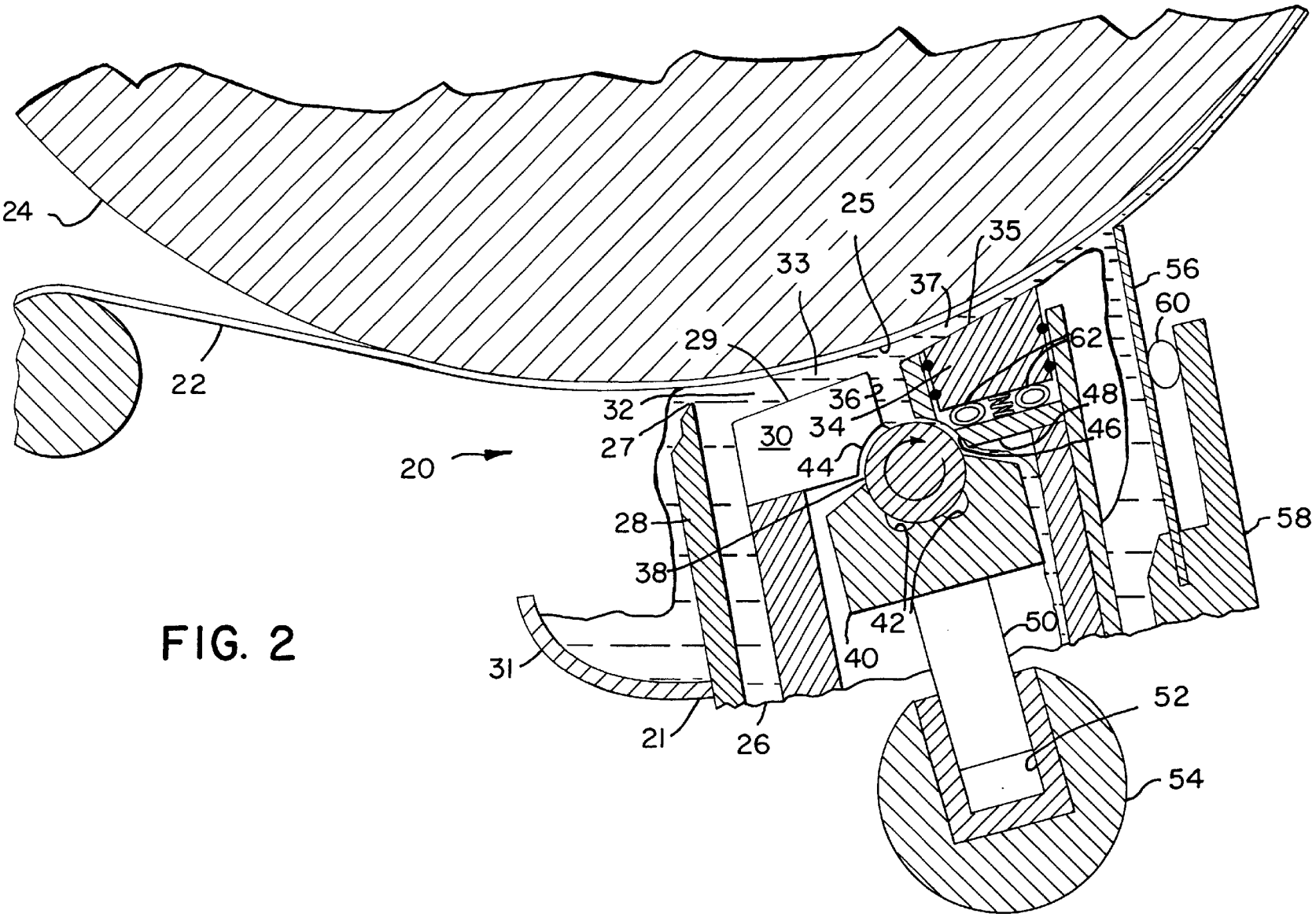
FIG. 2 is a schematic cross-sectional view of the coater of FIG. 1.

Referring more particularly to FIGS. 1–4 wherein like numbers refer to similar parts, a coater 20 is shown in FIG. 1. The coater 20 applies a thin film of coating to a substrate which is a paper web 22 that is guided around a backing roll 24. The coater 20 as shown in FIG. 2 has a coater head housing 21 with a coating feed inlet 26 positioned between an upstream overflow baffle 28 and a first fixed wedge 30. Coating is injected through the inlet 26 and overflows the lip 27 of the baffle 28. Excess coating is collected in a collection trough 31. An application chamber 32 is formed between the proximate opposed portion 25 of the paper web 22 supported by the backing roll 24, the overflow baffle 28, the fixed wedge 30 and a movable wedge 34.

The fixed wedge 30 has an application surface 29 that more closely approaches the web 22 as it extends downstream in the direction of web travel. The fixed wedge 30 has a converging angle of up to fifteen degrees, and is preferably between three and fifteen degrees. The length of the fixed wedge 30 in the machine direction should be between about one inch and about five inches.

The fixed wedge 30 defines an application region 33 between the static wedge 30 and the paper web substrate 22. Similarly the adjustable wedge member 34 has a surface 35 that defines an application region 37 between the adjustable wedge member and the web 22. The adjustable wedge 34 is spaced downstream from the fixed wedge 30 to define a cross machine direction gap which serves as an extraction port 36 for coating within the application chamber.

A rod 38 is positioned to control flow through the extraction port 36. The rod 38 is mounted for rotation in a holder 40 formed of a resilient material. Passageways 42 in the holder 40 may be supplied with water to lubricate and clean the rod as it rotates. The rod 38 is rotatable within a first conforming semi-cylindrical cavity 44 formed in the stationery wedge 30 and a second conforming semi-cylindrical cavity 46 formed in the support 48 for the movable wedge 34.

The rod 38 and rod holder 40 are mounted for motion toward and away from the backing roll 24 on a piston 50 that travels in a cavity 52 formed in a cross machine support 54. The rod 38 has a diameter of between three-eighths of an inch and two inches and is driven to rotate by a motor (not shown) at between one and one-hundred rotations per minute. The rate of rotation and the spacing between the rod 38 and the semi-cylindrical cavities 44, 46 controls the rate at which coating and air is extracted from the application chamber 32. The amount of coating through the extraction port 36 is driven by the pressure difference between the application zone and the atmosphere, and is controlled by the rotation of the rod 38. The coating extracted serves to eliminate a portion of the air entrained in the coating fluid thus improving the flow stability. The extraction port 36 also serves to remove the excess coating within the application chamber 32 for minimization of the magnitude of the flow variations within the application region, and for reduction of the mean pressure level in the application region to enhance the applicator runnability.

The purpose of a coater 20 is to apply a thin uniform layer of coating to the paper web 22. This involves a two-part process. The first part is to get coating into intimate contact with the paper web 22, the second part is to remove all but a thin uniform layer of coating from the web 22. The second function is accomplished with a final metering blade 56 that is mounted to a support 58 and intermittently supported by an inflatable air tube 60 positioned between the metering blade 56 and the support 58.

Establishing a uniform coating by bringing the coating into intimate contact with the web 22 involves displacement of a boundary layer of air that travels along with the web 22. The overflow of coating over the baffle plate 28 helps to prevent air from entering the application chamber 32. However, as machine speed increases it is necessary to bring the baffle plate 28 closer to the backing roll 24, yet there is a limit on how close the baffle plate 28 can be brought to the backing roll 22. If there is a paper break, the web can become wound around the backing roll which requires a gap to be left between the baffle plate 28 and the roll. Thus other mean of controlling and removing air from the application chamber are required.

Extraction of coating and air from the application chamber has been developed to improve coater performance at higher operating speeds. In our earlier application No. 08/518,093, filed Aug. 22, 1995 which is incorporated herein by reference, we described how an adjustable wedge similar to the wedge 34 can be used with an extraction port 36 to control the coater application chamber at higher web speeds.

The movable wedge 34 which is supported on pneumatic tubes 62 provides adjustment of the premetering device. The various adjustments of the rotation rate of the rod 38 and the pressure of the movable wedge 34 again the backing roll and the pressure of the final metering blade 56 against the web 22 can all be done while the papermaking machine is operating.

Pressure in the coater application chamber 32 is responsive to three factors: backing roll speed, inlet feed rate, and decreased distance between the baffle plate and the roll. As explained above there are limits on how close the baffle plate can be positioned with respect to the backing roll. Backing roll speed is determined by the velocity of the paper web which is determined by economic factors requiring maximum efficiency that in turn requires the highest economically feasible paper speed. This leaves only coater inlet feed rate as a means to control pressure in a conventional coater.

The use of an extraction port 36 with a rotatable rod 38 introduces another controllable variable which influences pressure in the coater application chamber. Because the amount of coating extracted can be easily adjusted by controlling the rotation speed of the rod 38, there may be no need to adjust inlet feed rate by modifying the baffle plate gap setting, the inflation pressure in the movable wedge tubes 62, the angle the coater head 21 makes with the backing roll, the width of the extraction port 36, etc. Adjusting these parameters is more difficult and can introduce undesirable secondary effects.

The amount of coating removed by the extraction port 36 is typically ten to fifteen percent of the total flow. Total extraction can be controlled by varying the rotation rate of the rod 38 and the spacing of the rod 38 from the conforming semi-cylindrical cavities, 44, 46. By adjusting the spacing of the rod 38 the range of rotation speeds required for the rod 38 can be minimized. By fully retracting the rod the flow of coating can be vented directly to the atmosphere. In the fully retracted position routine maintenance can be more easily performed.

The rod 28 should have a smooth surface to facilitate cleaning and minimize wear. The formation of dry coating deposits is to be avoided because the particles which form can interfere with applying the coating and can produce wear in the coater components. The dynamic nature of the rod acts as a self-cleaning mechanism. Coating is continuously being scraped off the rod by the holder. By reversing the direction of rod 38 rotation, contaminants plunged in the extraction gap can be more easily removed. The self cleaning ability of the rod 38 is a major feature of the coater 20.

The adjustable rod 38 not only improves the operational limits of a converging gap coater, but also simplifies the operational adjustments on the coater resulting from any change in machine speed or coating rheology.

Figure 3:
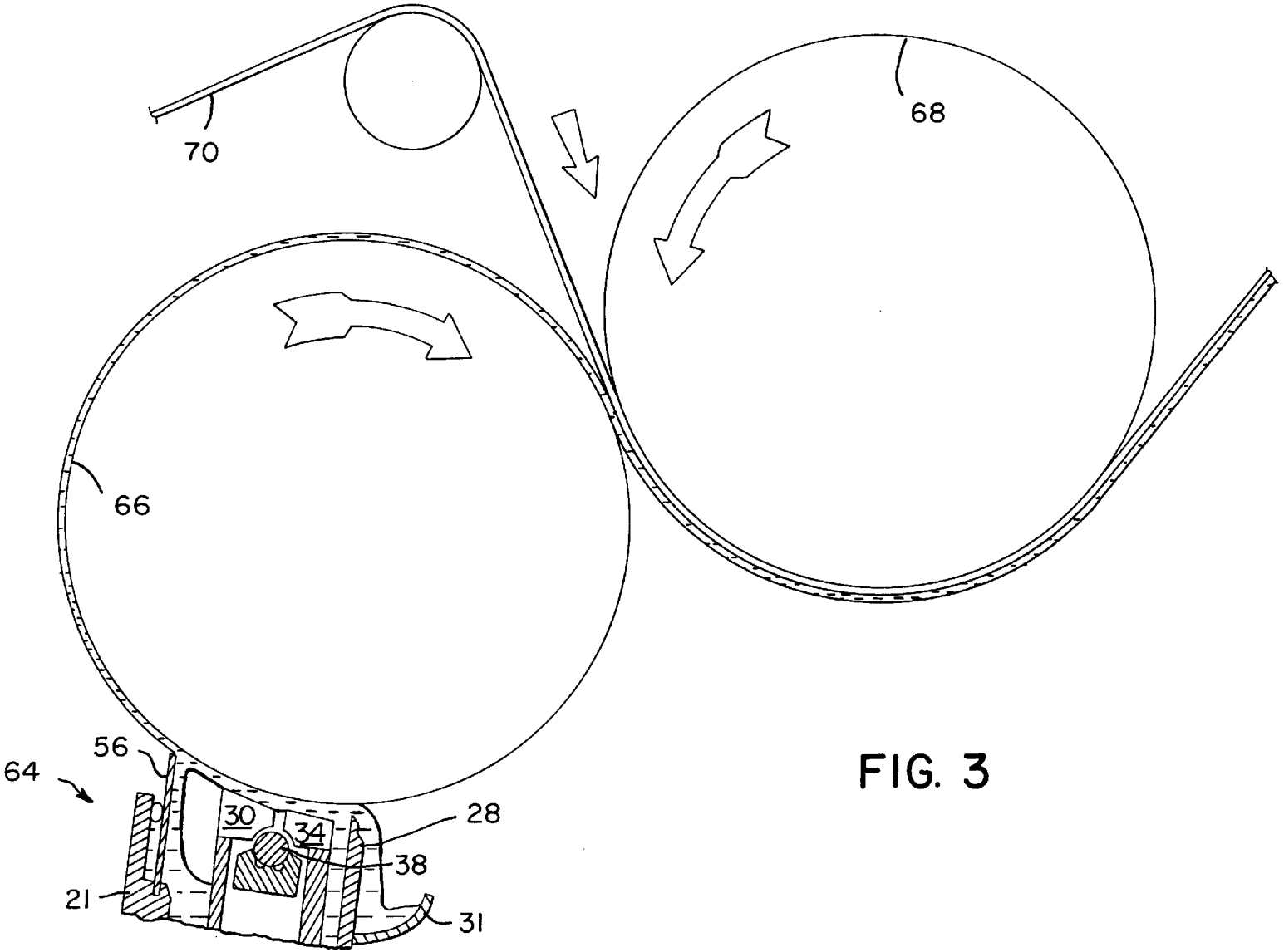
FIG. 3 is a schematic cross-sectional view of a size press employing the coater of FIG. 1.

As shown in FIG. 3, the coater head 21 can be used in a size press 64 to apply a coating to a substrate that is a backing roll 66 that is in nipping engagement with a second backing roll 68. A paper web 70 is fed between the first and the second nipping rolls 66, 68 where the coating is transferred from the first backing roll to the web 70.

Figure 4:
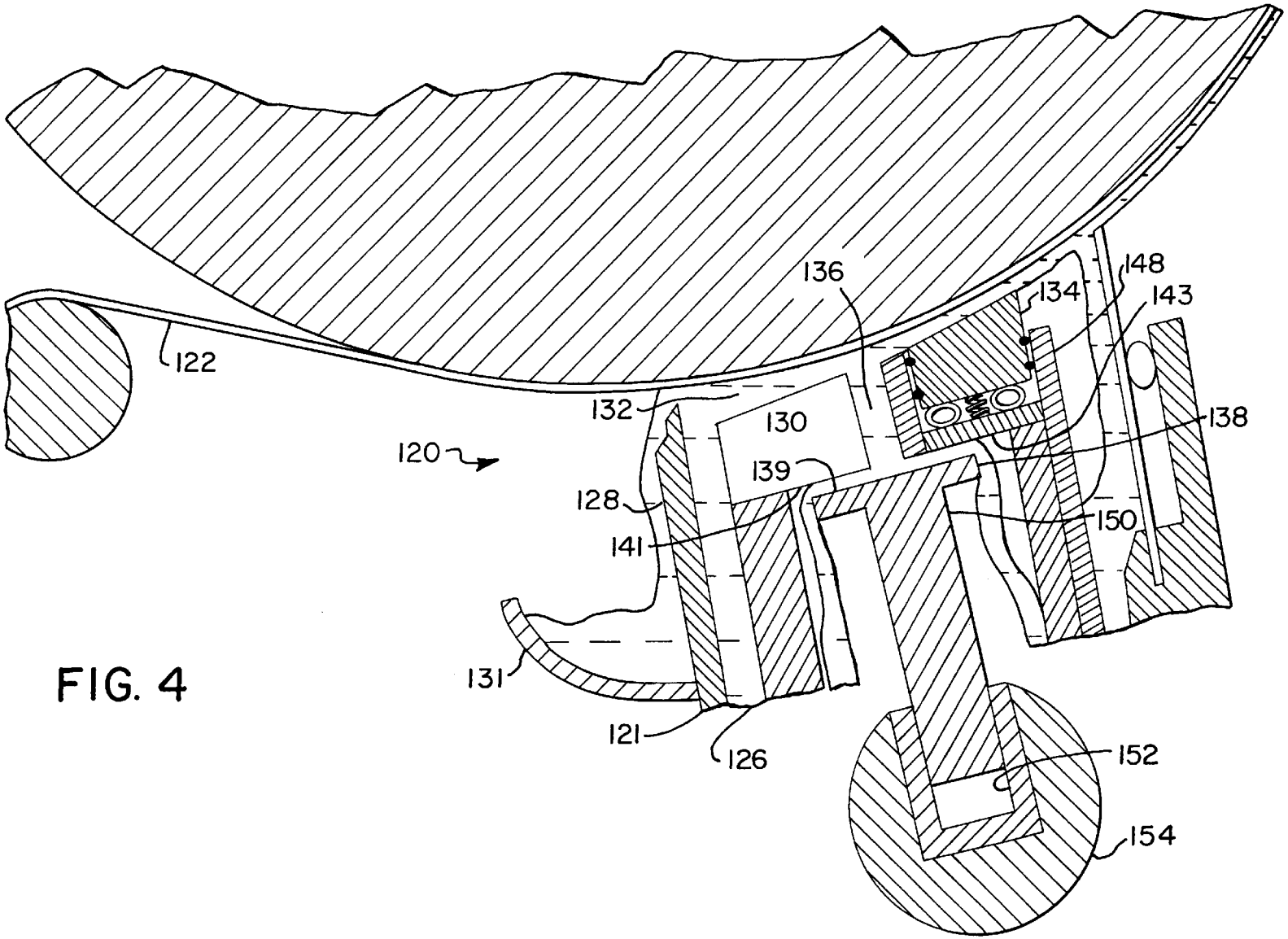
FIG. 4 is a schematic cross-sectional view of an alternative embodiment of the coater of FIG. 1.

An alternative embodiment coater 120 with a coater head 121 is shown in FIG. 4. The coater 120 applies a thin film of coating to a paper web 122 as the paper web 122 wraps around a backing roll 124. The coater 120 head 121 has a coating feed inlet 126 positioned between an overflow baffle 128 and a first fixed wedge 130. Coating is injected through the inlet 126 and overflows the baffle 128. Excess coating is collected in a collection trough 131. A coating application chamber 132 is formed between the paper web 122 supported by the backing roll 124, the overflow baffle 128, the fixed wedge 130 and a movable wedge 134. An extraction port 136 is formed between the fixed wedge 130 and the movable wedge 134.

An adjustable plate 138 is positioned to control flow through the extraction port 36. The plate 138 is mounted for motion toward and away from the backing roll 124 on a piston 150 that travels in a cavity 152 formed in a support 154. The plate 138 has a flow control surface 139 that is in spaced parallel relation to a bottom surface 141 below the fixed wedge 130 and a bottom surface 143 below the movable wedge holder 148. Adjustment of the plate 138 controls the pressure in the application chamber 132.

Figure 5:
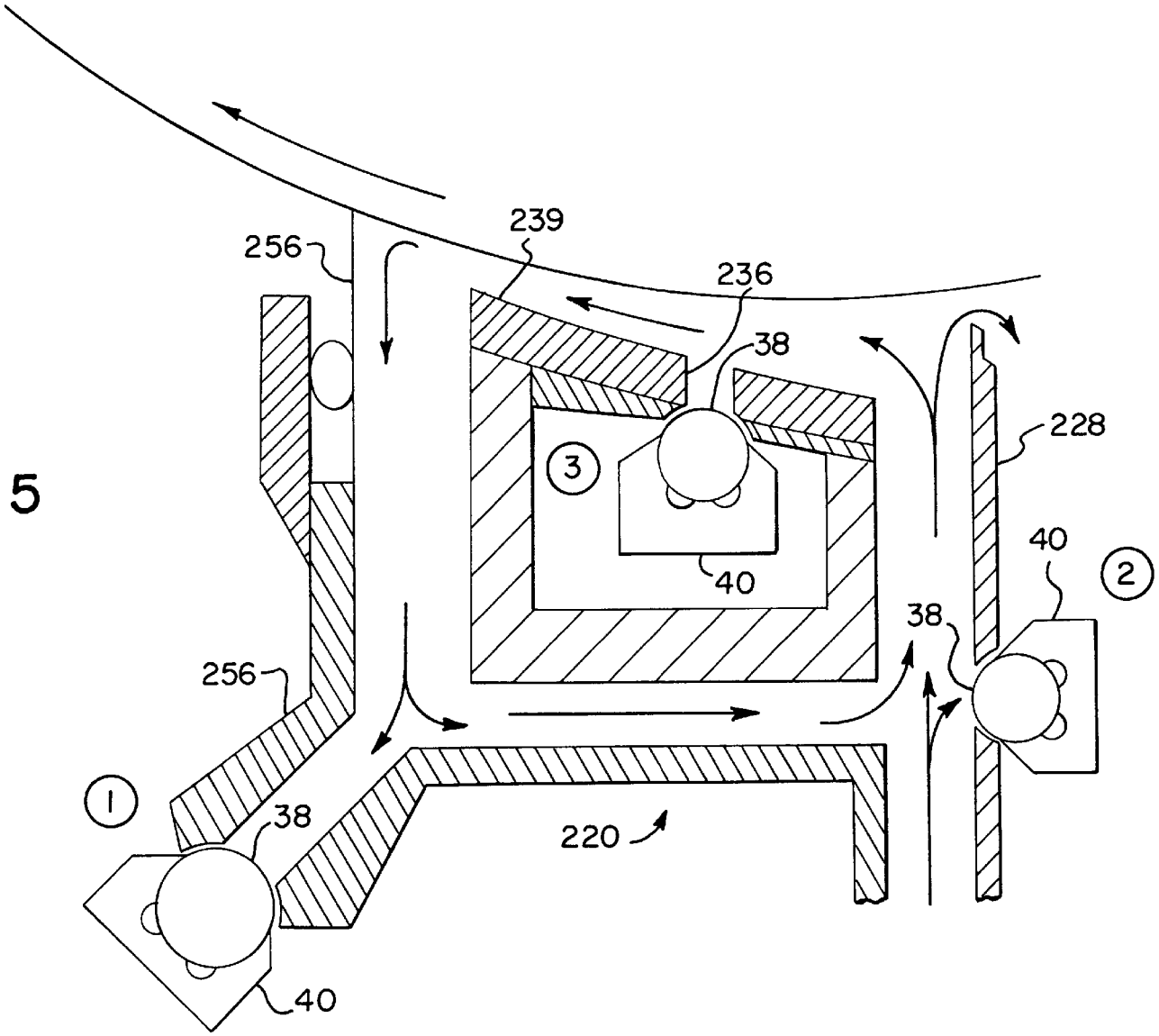
FIG. 5 is a schematic cross-sectional view of a alternative positions in which the extraction rod of FIG. 1 can be used.

It should be understood that the adjustable rod 38 and the rod holder 40 shown in FIG. 2 can be employed in various location within a coater 220 as shown in FIG. 5. Although the adjustable rod 38 would probably not be used in all the locations shown in FIG. 5 a particular coater design could make use of the extraction capability and control provided by the rod 38 at various location. Extraction through a opening in the overflow baffle 228 or through a extraction port 236 position internal to a premetering wedge 239 are possibilities. Further as shown in FIG. 5 an extraction port 241 adjacent to the premetering blade 256 could made use of a control means incorporating a rotating rod.

It should be understood that although the preferred embodiment employs a double wedge premetering design, as shown in FIG. 2, with a fixed wedge 30 and an adjustable wedge 34, other mechanisms for forming an adjustable wedge such as a blade, a rod, a shoe, or an adjustable hinged component installed instead of the adjustable wedge is possible. These configurations are shown in our earlier patent application of which this application is a continuation. Similarly the coater 120 shown in FIG. 4 could employ the foregoing structures instead of the movable wedge 34.

It should be understood that the hydraulic piston 50 and hydraulic cavity 52 of FIG. 2 and the hydraulic piston 150 and hydraulic cavity 152 could be replaced with other adjusting mechanisms such as by a pneumatic or mechanical actuation system.

It is understood that the invention is not limited to the particular construction and arrangement of parts herein illustrated and described, but embraces such modified forms thereof as come within the scope of the following claims.

We claim:

1. A coater apparatus for applying coating material to a moving substrate along a direction of travel said apparatus comprising:

a coater head housing disposed in close proximity to the substrate, wherein a coating application chamber is defined between the moving substrate and the coater head housing, the application chamber opening toward the substrate and extending along the substrate in a cross-machine direction, and wherein the application chamber receives and retains coating material, and wherein the application chamber is connected to a source of coating material;

portions of the coater head housing which define a baffle plate upstream of the application chamber with respect to the direction of travel of the substrate ,wherein the baffle plate has portions defining a lip spaced from the substrate, and wherein excess coating material within the application chamber overflows the baffle plate lip to escape the application chamber;

at least one premetering member in the application chamber extending from the coater head housing toward the substrate;

a coating extraction port defined in the housing through which coating and air can be removed from the application chamber, the extraction port connecting the application chamber with two semi-cylindrical cavities with one of the semi-cylindrical cavities arranged upstream with respect to the direction of travel of the substrate to the other of the semi-cylindrical cavities and each of the cavities extending in the cross machine direction;

a rod which extends in the cross machine direction and is mounted for rotation within the semi-cylindrical cavities so that rotation of the rod controls the amount of coating extracted from the application chamber, wherein the rod is mounted in a rod holder and wherein the rod and rod holder are mounted for motion toward and away from the substrate and wherein such motion opens and closes the extraction port.

2. The coater of claim 1 wherein the rod has a diameter of between three-eighth of an inch and two inches.

3. The coater of claim 1 further comprising a final metering blade positioned downstream of the application coating chamber and engaging the substrate to meter the thickness of a coating film for application on the substrate.

4. The coater of claim 1 wherein the substrate comprises a paper web supported by a cylindrical backing roll.

5. The coater of claim 1 wherein the substrate comprises a backing roll in a size press, the coating being applied to the backing roll for transfer to a paper web.

6. A coater apparatus for applying coating material to a moving substrate along a direction of travel, said apparatus comprising:

a coater head housing disposed in close proximity to the substrate, wherein a coating application chamber is defined between the substrate and the coater head housing, the application chamber opening toward the substrate and extending along the substrate in a cross-machine direction, and wherein the application chamber receives and retains coating material, and wherein the application chamber is connected to a source of coating material;

portions of the coater head housing which define a baffle plate upstream of the application chamber with respect to the direction of travel of the substrate, wherein the baffle plate has portions defining a lip spaced from the substrate, and wherein excess coating material within the application chamber overflows the baffle plate lip to escape the application chamber;

at least one premetering member in the application chamber extending from the coater head housing toward the substrate;

a coating extraction port defined in the housing through which coating and air can be removed from the application chamber, the extraction port connecting the application chamber with two semi-cylindrical cavities with one of the semi-cylindrical cavities arranged upstream with respect to the direction of travel of the substrate to the other of the semi-cylindrical cavities and each of the cavities extending in the cross machine direction;

a rod which extends in the cross machine direction and is mounted for rotation within the semi-cylindrical cavities so that rotation of the rod controls the amount of coating extracted from the application chamber, wherein the premetering member is comprised of two components and the extraction port forms a cross machine direction slot between the two components and wherein each component defines one of the respective semi-cylindrical cavities such that one of the semi-cylindrical cavities is arranged adjacent to the slot so that the rod is positioned beneath the slot in the semi-cylindrical cavities.

7. The coater of claim 6 wherein the substrate comprises a paper web supported by a cylindrical backing roll.

8. The coater of claim 6 wherein the substrate comprises a backing roll in a size press, the coating being applied to the backing roll for transfer to a paper web.

9. A coater apparatus for applying coating material to a substrate guided by a backing roll moving along a direction of travel said apparatus comprising:

an applicator comprising a coater head housing disposed in close proximity to the backing roll such that the substrate guided by the backing roll moves between the backing roll and the coater head housing, wherein the coater and coater head housing and the proximate opposed portion of the substrate over the backing roll defines an application chamber which opens toward the substrate and which extends along the substrate in a cross-machine direction, and wherein the application chamber receives and retains coating material, and wherein the application chamber is connected to a source of coating material;

portions of the coater head housing define a baffle plate upstream of the application chamber, with respect to the direction of substrate travel wherein the baffle plate has portions defining a lip spaced from the backing roll, and wherein excess coating material within the application chamber overflows the baffle plate lip to escape the application chamber;

a static wedge member fixedly mounted to the housing and which defines an application region between the static wedge member and the substrate, wherein the static wedge member has an application surface which more closely approaches the substrate as the static wedge member extends downstream with respect to direction of substrate travel, and wherein the application surface is substantially fixed with respect to the housing; and an adjustable wedge member moveably mounted to the housing, and which defines an application region between the adjustable wedge member and the substrate, downstream of the static wedge member, wherein the adjustable wedge member has an application surface which more closely approaches the substrate as it extends downstream defining an application gap of a variable height between the substrate and the application surface;

a coating extraction port defined between the static wedge member and the adjustable wedge member, through which coating and air can be removed from the application chamber; and a means for controlling the amount of coating removed from the application chamber through the extraction port.

10. The coater of claim 9 wherein the means for controlling the amount of coating removed from the application chamber is a rod which extends in the cross machine direction and is mounted for rotation in a rod holder, the rod being positioned to at least partly block the extraction port.

11. The coater of claim 10 wherein the rod has a diameter of between three-eighth of an inch and two inches.

12. The coater of claim 10 wherein the rod and rod holder is mounted for motion toward and away from the backing roll and wherein such motion opens and closes the extraction port.

13. The coater of claim 10 wherein the coating extraction port formed between the static wedge and the adjustable wedge forms a cross machine direction slot which opens into two semi-cylindrical cavities with one of the semi-cylindrical cavities arranged upstream with respect to the direction of travel of the substrate to the other of the semi-cylindrical cavities and each of the cavities extending in the cross-machine direction so that the rod is positioned beneath the slot in the semi-cylindrical cavities.

14. The coater of claim 9 wherein the means for controlling the amount of coating removed from the application chamber is a plate which extends in the cross machine direction and is mounted for motion toward and away from the backing roll and Wherein such motion opens and closes the extraction port.

15. The coater of claim 9 wherein the substrate comprises a paper web supported by a cylindrical backing roll.

16. The coater of claim 9 wherein the substrate comprises a backing roll in a size press, the coating being applied to the backing roll for transfer to a paper web.

17. An apparatus for applying coating material to a substrate moving in a direction of travel, the apparatus comprising:

a housing disposed near the substrate, wherein an application chamber is defined between the housing and the substrate, the application chamber receiving and retaining coating material from a source of coating material;

portions of the housing which define a baffle plate upstream of the application chamber with respect to the direction of travel of the substrate the baffle plate having portions defining a lip spaced from the substrate, excess coating material within the application chamber overflowing the baffle plate lip to escape the application chamber;

a first premetering member mounted to the housing to define a first application region between the first member and the substrate;

a second premetering member moveably mounted to the housing to define a second application region between the second member and the substrate, the second application region being downstream of the first member with respect to the direction of travel of the substrate;

an extraction port defined between the first premetering member and the second premetering member through which coating and air can be removed from the application chamber; and a means for controlling the amount of coating removed from the application chamber through the extraction port, wherein the means for controlling the amount of coating removed from the application chamber is a rod which extends in the cross machine direction and is mounted for rotation in a rod holder, the rod being positioned to at least partly block the extraction port, and wherein the coating extraction port formed between the first premetering member and the second premetering member defines a cross machine direction slot which opens into two semi-cylindrical cavities wherein one of the semi-cylindrical cavities is arranged upstream with respect to the direction of travel of the substrate to the other of the semi-cylindrical cavities and each of the cavities extending in the cross machine direction so that the rod is positioned beneath the slot in the semi-cylindrical cavities.

18. The apparatus of claim 17 wherein the rod has a diameter of between three-eighths of an inch and two inches.

19. An apparatus for applying coating material to a substrate moving along a direction of travel, the apparatus comprising:

a housing disposed near the substrate, wherein an application chamber is defined between the housing and the substrate, the application chamber receiving and retaining coating material from a source of coating material;

portions of the housing which define a baffle plate upstream of the application chamber with respect to the direction of substrate travel, the baffle plate having portions defining a lip spaced from the substrate, excess coating material within the application chamber overflowing the baffle plate lip to escape the application chamber;

a first premetering member mounted to the housing to define a first application region between the first member and the substrate;

a second premetering member moveably mounted to the housing to define a second application region between the second member and the substrate, the second application region being downstream of the first member with respect to the direction of substrate travel;

an extraction port defined between the first premetering member and the second premetering member through which coating and air can be removed from the application chamber; and a means for controlling the amount of coating removed from the application chamber through the extraction port, wherein the means for controlling the amount of coating removed from the application chamber is a rod which extends in the cross machine direction and is mounted for rotation in a rod holder, the rod being positioned to at least partly block the extraction port, wherein the rod and rod holder is mounted for motion toward and away from the substrate and wherein such motion opens and closes the extraction port.

20. A method of coating a moving substrate along a direction of travel comprising the steps of:

positioning a coater head housing below and in close proximity to a substrate;

moving the substrate over the coater head housing, wherein the coater head housing and the proximate opposed portion of the substrate define an application chamber which opens toward the substrate and which extends along the substrate in a cross-machine direction;

continuously supplying coating to fill the application chamber with coating to be applied to the substrate;

overflowing the application chamber and spilling coating over a lip spaced from the substrate, the lip formed by a baffle plate upstream of the application chamber with respect to the direction of travel of the substrate;

premetering the coating onto the substrate in the application chamber with a premetering member extending from the coater head housing towards the substrate;

extracting coating and air entrained in the coating from the application chamber through an extraction port;

controlling the amount of coating and air removed through the extraction port by rotating a rod positioned in two semi-cylindrical cavities with one of the semi-cylindrical cavities arranged upstream with respect to the direction of travel of the substrate to the other of the semi-cylindrical cavities and each of the cavities extending in the cross-machine direction communicating with the extraction port, wherein the step of controlling the amount of coating and air removed includes adjusting the spacing of the rod from the semi-cylindrical cavities.

21. The method of coating a moving substrate of claim 20 wherein the step of controlling the amount of coating and air removed further comprises rotating the rod at between one and one-hundred rotations per minute.

22. The method of coating a moving substrate of claim 20 wherein between ten and fifteen percent of the coating supplied to the application chamber is removed through the extraction port.

23. The method of coating a moving substrate of claim 20 wherein the substrate comprises a backing roll, and further comprising the step of transferring the coating from said backing roll to a moving web.

24. The method of coating a moving substrate of claim 20 wherein the substrate comprises a paper web which is supported by a backing roll.

* * * * *